United States Patent [19]

Hockensmith

[11] Patent Number: 4,488,366

[45] Date of Patent: Dec. 18, 1984

[54] CALENDAR WITH COMBINED DISPLAY OF CONSECUTIVE MONTHS

[76] Inventor: Richard P. Hockensmith, 7014 97th Ave., Seabrook, Md. 20801

[21] Appl. No.: 531,288

[22] Filed: Sep. 12, 1983

[51] Int. Cl.[3] ..... G09D 3/04

[52] U.S. Cl. ..... 40/119; 40/530; 283/2; 281/5

[58] Field of Search ..... 40/119, 530, 107, 526; 283/1, 2; 281/5

[56] References Cited

U.S. PATENT DOCUMENTS

| | | | |
|---|---|---|---|
| Re. 22,839 | 2/1947 | Potter | 40/107.X |
| 1,697,350 | 1/1929 | Eubank | 40/530 |
| 3,883,971 | 5/1975 | Weiss | 40/119 |
| 4,041,627 | 8/1977 | Lyman | 40/526 |

FOREIGN PATENT DOCUMENTS

| | | | |
|---|---|---|---|
| 521684 | 3/1931 | Fed. Rep. of Germany | 40/530 |

*Primary Examiner*—Gene Mancene
*Assistant Examiner*—Wenceslao J. Contreras
*Attorney, Agent, or Firm*—Lowe King Price & Becker

[57] ABSTRACT

A calender structure includes linking apparatus for displaying, in a linked and continuing fashion, time sequences shown on separate pages thereof. The individual pages are provided with specific hinging structures to permit simultaneous viewing of the last portion of one month and the first portion of a next month, for example, so that a continuing display is provided for linked time sequences notwithstanding the fact that such sequences are provided on separate pages. A single hinging operation results in the continuing display, thus avoiding the necessity for repeatedly turning between two calander pages at periods approaching an end of the month.

21 Claims, 7 Drawing Figures

CALENDAR WITH COMBINED DISPLAY OF CONSECUTIVE MONTHS

BACKGROUND OF THE INVENTION

This invention relates to calendars, and more specifically to calendars having separate pages in a hinged arrangement for display of consecutive months or other time periods.

The use of printed materials to display time sequences, and particularly the use of calendars to display designated arrangements of dates, is well known. In a typical calendar the pages thereof may be hinged attached to a backing surface, each page representing a month, or some other time period.

A user typically relies on the display on a particular page for determining time availability and scheduling. Towards the end of a month, when activities need to be scheduled in the next succeeding month, a user of a typical prior art calendar is required to turn from the page showing the current month to the page showing the next succeeding month in order to determine time availability and to schedule such events.

In order to provide some reduction in the amount of flipping and page turning required towards the end of a month, it is known in the prior art to provide a miniature representation of the dates of the succeeding month. While such representations reduce the requirement for page flipping when it is merely desired to determine the coincidence between weekdays and calendar dates, the prior art nonetheless requires such repeated page turning for actual scheduling of events in the upcoming month. The repetitive and inconvenient turning of pages is necessitated by the fact that the specific activity to be scheduled must still be written in the appropriate location of the actual page representing the next month, since making an annotation on the miniature representation of that next month is, in the first instance, difficult because of reduced size, and in the second instance, ineffective for providing the needed reminder to a user once the next month arrives and the calendar page appropriately turned.

There is thus a need in the prior art to provide a calendar upon which appropriate scheduling may be made for a succeeding month, without the necessity for repeatedly turning the pages thereof at the end of the month, thus avoiding redundant and erroneous planning or scheduling, and providing visibility of one's notes for succeeding time periods.

In one prior art calendar, described in Dailey, U.S. Pat. No. 669,319, there is disclosed an arrangement wherein a current and a succeeding month may be simultaneously shown. However, such a calendar requires the use of a continuous fan-folded display of all the months of a year on a single lengthy sheet. In the calendar described therein, when a month draws to a close, the calendar fan-fold is unfolded once to expose the page showing the next succeeding month. Once the next succeeding month draws to a close, the fan-fold is unfolded one more time.

Clearly, the page illustrating the previous month must be detached from the fan-folded arrangement in order to maintain a reasonable size for the calendar. Thus, any record keeping function of the calendar for future recollection is destroyed by the arrangement. If, on the other hand, a user chooses to retain each of the expired months, a difficult refolding process is necessitated to regenerate the fan-folded arrangement for the expired months.

There is thus a need in the prior art for a multipage calendar providing a simultaneous display of a plurality of time periods, notwithstanding a pagewise division therefor, and permitting straightforward retention and storage of data entered on the multiple pages.

SUMMARY AND OBJECTS OF THE INVENTION

It is accordingly an object of the present invention to overcome the difficulties of the prior art and to provide a calendar structured for simultaneous display of successive periods of time, such as months or weeks of a month.

It is a more specific object of the invention to provide a multipage calendar wherein at least a last portion of a first month may be viewed simultaneously with at least a first portion of a second month to enable proper scheduling for both months without the necessity of repeated page turning.

It is still another object of the invention to provide a simple structure enabling portions of successive months to be viewed simultaneously and for maintaining records associated with expired months.

In accordance with these and other objects of the invention, there is thus provided a means for simultaneously exposing at least a last portion of a page representing one month, together with at least a first portion of a page representing the next month in a calendar having a plurality of separate, hingedly arranged, pages. Preferably, the means for simultaneously exposing the portions of successive months includes a hinging structure. The hinge structure connects first and last portions of each of the separate pages representing the various months, and is located between a pair of rows of the pages identifying particular weeks thereof. Thus, by appropriately hinging the calendar pages, a user sees a continuous display of weeks, notwithstanding the fact that these weeks are provided on consecutive, separate pages of the calendar for different months.

Preferably, the hinge structure is formed as a fold line on each page, the fold line being convex with respect to the printed matter on the page, so that, once folded, the page displays the printed matter at least on one side of the fold, representing the last portion of the month.

Although the calendar may represent varying arrangements of time periods and sequences, preferably the calendar includes horizontal rows representing weeks, the rows being vertically displaced from each other in an arrangement representing a month. The fold line is preferably provided between two of the weeks illustrated on the calendar page.

Additionally, on each page representing a month there are provided indicia identifying the month and disposed below the fold line, so that upon folding of the page a clear identification of the month is provided, both for the segment representing the last portion of the expiring month and for the segment representing the next succeeding month.

Additional month-identifying indicia may be provided atop the first week on a page, thereby better to identify a division between the last portion of the expiring month and the first portion of the next succeeding month.

In yet another aspect of the invention, there is provided means for retaining the folded page in its folded position for display, together with the succeeding nonfolded page. The retaining means may include a pair of apertures, both above and below the hinging structure, to permit attachment of the folded page to a mounting means for the calendar.

BRIEF DESCRIPTION OF THE DRAWING

These and other features, objects and advantages of the present invention will become apparent to one of ordinary skill in the art upon perusal of the specification and claims hereof, particularly when taken in conjunction with the accompanying drawings, wherein like reference numerals represent like elements. In the drawing.

DETAILED DESCRIPTION OF THE PREFERRED EMBODIMENT

Figure 1:
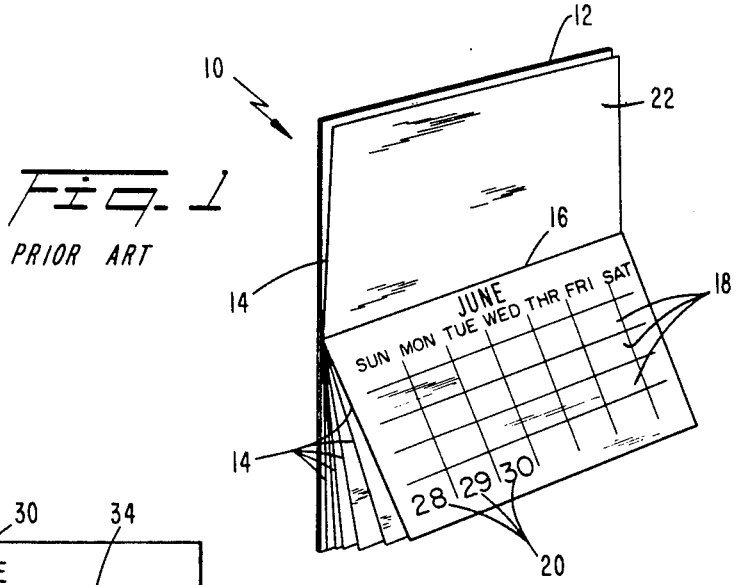
Fig. 1 PRIOR ART
FIG. 1 illustrates a multipage calendar of the prior art.

Referring now to FIG. 1, there is generally shown at 10 a multipage calendar in accordance with the prior art. Therein, a backing page 12 is shown for mounting of the calendar on a wall, for example. Such a backing page is typically made of a sheet of thicker material than the calendar pages to provide rigidity and support for the calendar. Alternatively, a thin backing may be provided and the printed calendar portions may be made of thicker material, mounted on the thin backing in an appropriately spaced arrangement.

A plurality of separate, individual pages of the calendar are shown at 14, the pages being hingedly attached at a hinge 16 to backing page 12.

The pages 14 are arranged in a particular first sequence, corresponding to successive time periods represented thereby. The successive periods may represent the sequence of months in a year, or groups of weeks, for example. On each page is arranged a plurality of rows 18, arranged in a particular second sequence. The rows may represent the successive weeks of the month. In each row is provided a third sequence of indicia 20 identifying particular time units. For typical calendars, as has been previously mentioned, each page represents a month, each row represents a week, and the various indicia represent dates of the various days of the month.

As is known, upon the expiration of a particular month, the page representing that month may be rotated about the hinge 16 to a position illustrated at 22 wherein the next succeeding month is made visible. Alternatively, upon expiration of a month the page representing that month may be detached from the calendar.

Such prior art calendars may typically provide scheduling grids thereon, in the shape of a grid each unit of which is identified by one of the indicia 20. Thus, in order to schedule various activities and events, a user annotates a particular block in the grid with an event scheduled for the date associated with the specific indicia thereof. For a typical user such events may be scheduled from several days to several weeks in advance. Thus, when a time period (e.g., a specific month) is about to expire, events are typically being scheduled for dates in the next succeeding time period (e.g., the next period of weeks or the next month). Since it is still desirable to view the scheduling arrangement and calendar arrangement for the expiring month, any scheduling or review of scheduled arrangements for the succeeding month necessitates repeated turning of the page representing the expiring month to expose for view and scheduling the desired grid blocks of the next month. Such repeated page turning is an inconvenience to a user.

Figure 2:
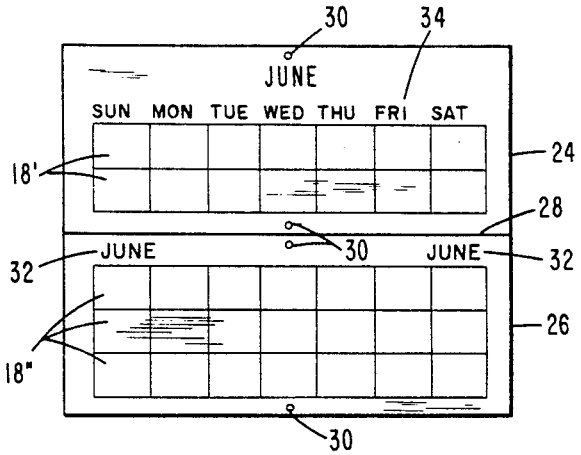
FIG. 2 illustrates a page for a multipage calendar incorporating the present invention.

In accordance with the present invention, there is shown a calendar page at FIG. 2 which reduces the necessity for turning pages in order to schedule events between two succeeding months. As shown therein, a page representing a particular month is presented in two portions. The first and second portions of the page, representing first and second portions of the month, for example, are shown at 24 and 26, respectively. As is seen in the Figure, each portion may include a plurality of rows therein. Thus, rows 18' are the rows selected for presentation in the first portion 24, while rows 18" are the rows chosen for presentation in the second portion 26. The two portions are separated by a hinge 28, permitting portions 24 and 26 to be hingedly rotated with respect to one another. As is further seen in the figure, a pair of retaining means 30, in the form of apertures, may be provided, for reasons which will become apparent with reference to FIGS. 3 and 4. Apertures 30 are preferably disposed on either side of hinge 28.

Additionally, there are provided indicia 32, identifying the specific month, and located below the hinged connection at 28.

As is well known, calendars also include indicia (shown at 34, for example) identifying the days of the week. Although not shown in the embodiment of FIG. 2, it should be recognized that indicia 34 may be similarly repeated below hinge 28, and preferably below indicia 32, thereby to identify the days in rows 18" of the second portion 26 of the page.

Figure 3:
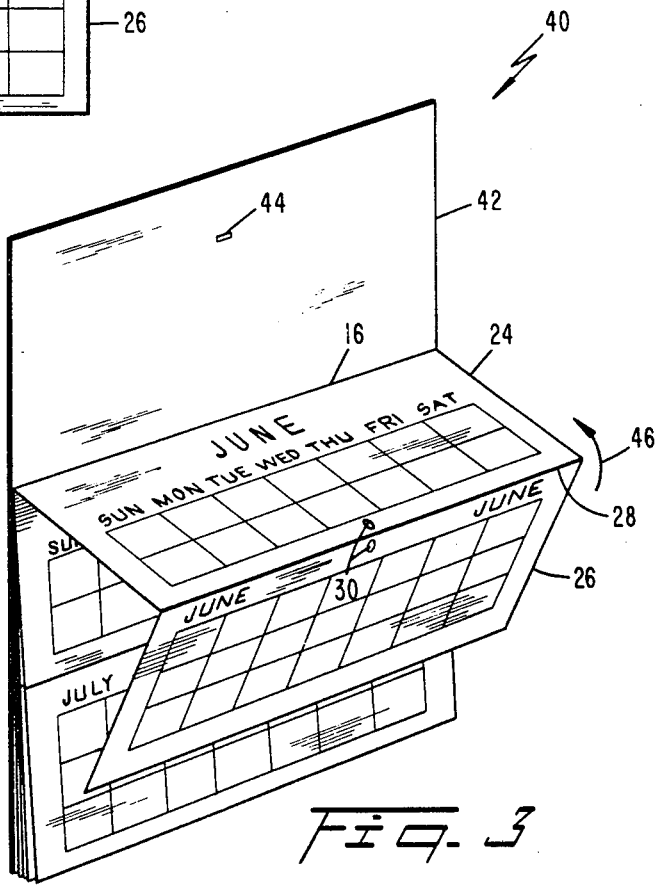
FIG. 3 shows a calendar incorporating a page shown in FIG. 2 and the use thereof.
Figure 4:
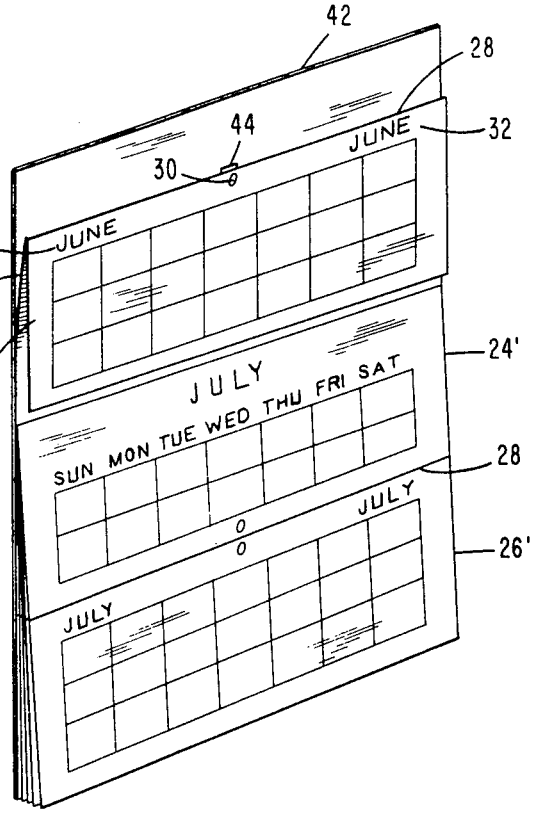
FIG. 4 illustrates the calendar of FIG. 3 arranged in accordance with the present invention to display portions of succeeding months.

Referring now to FIGS. 3 and 4, there is shown a calendar 40 embodying the present invention. The calendar 40 includes a backing and support structure 42 and a mounting apparatus 44 for attachment of calendar 40 to a wall or other support, laying on a desk or for use as a pocket calendar. Preferably, the mounting apparatus may comprise an aperture for insertion of a fastening element, such as a thumbtack, a nail or the like, thereby to affix the backing and support structure 42 to the wall or other support.

When the calendar displays the month of June, for example, and more specifically when the appropriate calendar dates are included in second portion 26 of the calendar page, the calendar page according to the invention may be rotated about hinge 28 as shown in FIG. 3. Along with rotation of portions 24 and 26 of the page about hinge 28, the page itself may be rotated about hinge 16 in the direction shown by arrow 46.

Such rotation of the page reveals the next succeeding month, July for example, on the following page of the calendar while, at the same time, retaining in view the last portion of the month of June, as shown in FIG. 4.

Accordingly, any scheduling of events both in the remaining portion of the month of June and in the succeeding month of July may be arranged without further necessity for turning of calendar pages. The last portion of the month of June is displayed simultaneously with the month of July.

By reference to FIG. 4, it is noted that indicia 32, identifying the previous month, remain visible in the folded portion therefor. Accordingly, both months are identified by the calendar. Additionally, it is noted that apertures 30, on both sides of hinge 28, line up with the mounting apparatus 44 for the calendar.

Although it has previously been described as incorporating a nail or another fixing structure, along with an aperture, it should be appreciated that other mounting structures may be utilized. For example, a hook-and-loop type of arrangement (commercially marketed under the trademark Velcro) may be utilized. For example, a hook type of fabric may be provided at mounting apparatus 44 and at the element previously referred to as aperture 30, below hinge 28 in second portion 26 in each of the calendar pages. A loop type of fabric material may be provided at the upper mounting portion, shown as aperture 30 in FIG. 2 for the first portion 24 of each of the pages. Thus, as each page is rotated about hinge 16, the loop type of material found on the first portion thereof will engage the hook type of material at the second portion of the preceding page, or originally found at mounting apparatus 44 on the backing sheet. Of course, the hook-and-loop type of materials may be interchanged.

It should also be understood that additional mounting apertures may be provided in the pages of the inventive calendar at the top and bottom of first portion 24 and at the bottom and top of second portion 26, for example, for securing the various folds.

It is thus seen that, with the aid of the present invention, a user has ready access to the actual calendar pages identifying a succeeding month even during the last portion of a current month, thereby to enable annotation and review of the entries in each of a number of grid positions on the calendar pages.

Unlike prior art calendars wherein an entire representation of the successive months may be printed in miniature form on a current month, the present invention presents the actual grid structure of the next month, permitting full annotation thereof without requiring repeated page turning, and further without requiring the need to transcribe any annotations provided to the miniaturized version of the prior art once the page is finally turned to display the next succeeding month. Further, unlike the prior patented calendar hereinabove described, portions of both months are shown after a single simple hinging operation, each of the pages being retained without the necessity of detaching the same in order to avoid an unwieldy manipulation of an elongated, fan-folded sheet of paper.

It should be recognized that the advantages of the present invention accrue from the provision of a hinging structure for each of the pages. Hinge 28 may be provided in the form of a precreased or prefolded line on each page at a location intermediate printed portions identifying two portions of a month. The fold line is provided in conjunction with a retaining means provided for each of the calendar pages, and along with identifying indicia provided therebelow for maintaining identification of the preceding month subsequent to a folding operation. Thus, a one-time folding or adjustment of a page or surface of a calendar constructed in accordance with the present invention provides continued visibility of the last weeks of a month along with the next weeks of the following month without the necessity for repeatedly lifting, flipping or turning the page identifying the month to obtain such information. Of course, it is recognized that the inventive feature may be applied to bound desk-type calendars or pocket calendars, presented in the form of a book, for example, without the requirement of hanging the calendar on a wall or other support.

Figure 5A:
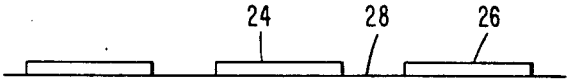
FIGS. 5A, 5B and 6 disclose alternate embodiments of the invention usable for a desk or pocket calendar.
Figure 5B:
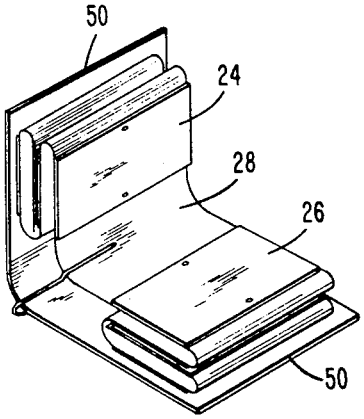

One such embodiment is shown in FIGS. 5A and 5B, wherein the calendar portions 24 and 26 for successive time periods are separated by hinge 28 formed of a thin backing material, substantially thinner than the portions themselves. Portions 24 and 26 may comprise printed strips, for example, or other elements, separately mounted on a continuous backing which forms hinges 28. A thickened cover material 50 binds the pocket version of the inventive calendar. The entire structure may be formed in the size of a standard checkbook, for example, the appropriate calendar portions being retained to the appropriate cover segment so that upon opening the calendar displays the current time period. Of course, the cover may be made of more or less flexible material. Where cover 50 is formed of a rigid support, the structure of FIGS. 5A and 5B, incorporating a serpentine fold of the calendar, may be utilized as a desk calendar.

The structure shown in FIGS. 5A and 5B thus permits a random fold to be inserted between the various portions of the calendar representing successive time periods. By advantageously folding the calendar as shown in FIG. 5B, it is noted that for each one period advance in time it is only necessary to remove one additional fold of the calendar from one cover to the other. Moreover, upon opening the pocket version of the calendar, the current time period will be displayed without the necessity for leafing through a number of calendar pages.

Figure 6:
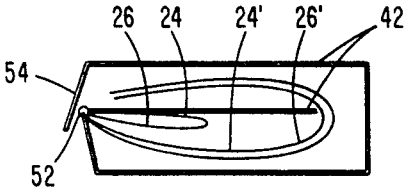

Referring to FIG. 6, another embodiment of the invention is shown for use as a pocket calendar. Therein, the structure of FIG. 4 is provided with an elongated cover 42, of sufficiently sturdy material to protect the calendar pages in pocket use. As is apparent from FIG. 6, the pages representing current and future months, represented by sections 24′ and 26′, for example, may be folded over the upper section of backing 42. Additionally, backing 42 is provided with an elongated bottom portion to permit encasing of the complete length of the folded future months therein. Cover 42 may be provided with a hinge structure 52, which may be a spiral hinge, for example, to which both the future months and the previously folded months, represented by sections 24 and 26, may be attached. Finally, cover 42 may be provided with a separate fastening and closure structure 54 which may be used to close cover 42 upon itself. Closure 54 may comprise a portion of backing 42 having hook or loop type material for engaging a portion of backing 42 adjacent hinge 52, with a cooperating loop or hook material. Alternatively, a snap closure may be provided. Any fastening means may be used, however.

It should also be recognized that although the upper portion of backing 42 is shown as extending beyond the length of the folded past months, this section may be removed to make the pocket version more compact. Preferably, the length of backing portion 42 for the past months corresponds to the length of section 24 or 26, thus permitting the sheets representing the future months to be folded about their hinged portion 28, in a concave fashion, for compact enclosure within backing 42 for pocket use.

The foregoing description of a preferred embodiment of the present invention has been presented for purposes of illustration and description. It is not intended to be exhaustive or to limit the invention to the precise form disclosed, and obviously many modifications and variations are possible in light of the above teachings. The embodiment was chosen and described in order best to explain the principles of the invention and its practical application thereby to enable others skilled in the art best to utilize the invention in various embodiments and with various modifications as are suited to the particular use contemplated. It is intended that the scope of the invention be defined by the claims appended hereto.

I claim:

1. In a calendar having a plurality of separate pages representing particular time periods, hingedly arranged in a first sequence, each page having a plurality of rows arranged in a second sequence, each row identifying a third sequence of indicia representing specified time units, the improvement comprising:

means for simultaneously exposing at least a last portion of the second sequence of rows on one page of the calendar together with at least an initial portion of the second sequence of rows on the next page of the calendar, said means for simultaneously exposing comprising a hinging means for hingedly connecting first and last portions of a page, said hinging means provided on each of said separate pages intermediate two of said second sequences of rows thereon, whereby a continuous sequence of rows, representing consecutive ones of said third sequences of time units and provided on successive ones of said pages, is displayed simultaneously to a user.

2. The calendar improvement of claim 1 wherein said hinging means comprises a fold line convex with respect to said indicia identifying time units, thereby to cause a page folded along said fold line intermediate said rows thereof to display at least said indicia representing the last portion of the page on one side of the fold line.

3. The calendar improvement of claim 1 wherein each of said third sequences is arranged in a horizontal row, said horizontal rows being vertically displaced from one another in said second sequence along a page, said hinging means being provided between two of said horizontal rows.

4. The calendar improvement of claim 3 wherein said time units identified by said indicia are arranged for identifying days of a month, said rows identify weeks and said periods of time represented by said pages are months, whereby said calendar displays a continuing sequence of weeks overlapping an ending and beginning of a pair of consecutive months.

5. The calendar improvement of claim 3 wherein said hinging means comprises a fold line, and said pages each include further indicia identifying a month represented thereby, said further indicia being disposed below said fold line, whereby said calendar provides identification of the month represented by the last weeks of a folded page and further provides identification of the month represented by the next page.

6. The calendar improvement of claim 5 wherein said pages further each include additional indicia disposed above the first week thereof for identifying the month represented thereby, whereby said calendar provides identification of a division between the last portion of one month and the first portion of the next month.

7. The calendar improvement of claim 5 wherein said pages further each include additional indicia disposed below the last week thereof for identifying the month represented thereby.

8. The calendar improvement of claim 1 further comprising retaining means disposed along the hinging means of each page for retaining a page in a folded position for display together with a successive page.

9. The calendar improvement of claim 8 wherein said calendar includes a mounting means for mounting on a wall and wherein said retaining means comprises a pair of apertures disposed above and below said hinging means for attachment to the mounting means.

10. The calendar improvement of claim 8 wherein said calendar includes a support means for supporting the calendar on a desk.

11. The calendar improvement of claim 10 wherein said retaining means comprises a pair of apertures disposed above and below said hinging means for attachment to the mounting means.

12. The calendar improvement of claim 10 wherein said retaining means comprises hook and loop material for attaching the calendar portions to a portion of said support means.

13. The calendar improvement of claim 10 wherein said calendar includes a cover means for covering said calendar for use as a pocket calendar.

14. The calendar improvement of claim 13 wherein said retaining means comprises a pair of apertures disposed above and below said hinging means for attachment to the mounting means.

15. The calendar improvement of claim 13 wherein said retaining means comprises hook and loop material for attaching the calendar portions to a portion of said support means.

16. The calendar improvement of claim 2 comprising means for compactly folding pages representing past time periods and for further folding pages representing future time periods differently, for carrying said calendar in a compact fashion and thereby permitting said calendar to display a current time period upon unfolding.

17. The calendar improvement of claim 16 wherein said means for compactly folding comprises a backing structure hingedly attached to said pages.

18. The calendar improvement of claim 17 wherein said backing structure includes a first section at least as long as said page folded to display said last portion thereof and disposed therebehind and for causing said pages representing future time periods to fold concavely with respect to said indicia identifying time units.

19. The calendar improvement of claim 18 wherein said backing structure includes a second section for surrounding said pages representing said future time periods, said second section having closure means attached thereto.

20. The calendar improvement of claim 1 wherein said means for simultaneously exposing comprises a backing structure hingedly attached to said pages, said backing structure being substantially thinner than said pages and including a plurality of hingedly connected sections each at least as long as said portions of said pages when folded to display said portions thereof, said pages and portions mounted on said first sections and separated from one another on opposite sides of the hinged connections of said first sections for permitting random folding about said hinges.

21. In a calendar having a plurality of separate pages representing months, hingedly arranged in a first sequence, each page having a plurality of rows arranged in a second sequence representing weeks, the improvement comprising:

means for simultaneously exposing at least a last portion of the weeks on one page of the calendar together with at least an initial portion of the weeks on the next page of the calendar, said means for simultaneously exposing comprising a convex fold means connecting first and last portions of a page, said convex fold means provided on each of said separate pages intermediate two of said weeks thereon, said convex fold means thereby operable for displaying a continuous sequence of rows, representing consecutive weeks of successive months.

* * * * *